US006793429B2

(12) United States Patent
Arrison

(10) Patent No.: US 6,793,429 B2
(45) Date of Patent: Sep. 21, 2004

(54) CHALK HOLDING DEVICE

(76) Inventor: William Q. Arrison, 135 Old River Rd., Milford, NJ (US) 08848

( * ) Notice: Subject to any disclaimer, the term of this patent is extended or adjusted under 35 U.S.C. 154(b) by 0 days.

(21) Appl. No.: 09/911,891

(22) Filed: Jul. 24, 2001

(65) Prior Publication Data

US 2002/0032069 A1 Mar. 14, 2002

Related U.S. Application Data

(60) Provisional application No. 60/220,936, filed on Jul. 26, 2000.

(51) Int. Cl.[7] ..... B43K 21/00; B43K 21/22; B43K 21/04; A63D 15/16

(52) U.S. Cl. ..... 401/93; 401/117; 401/94; 401/92; 401/82; 401/55; 473/36

(58) Field of Search ..... 473/1, 2, 35–39, 473/FOR 35–FOR 39; D19/35, 36, 53, 55, 51; 401/6, 88, 89, 62, 92, 93, 109, 107, 84, 99, 112, 117, 53, 116; 33/27.01, 27.03

(56) References Cited

U.S. PATENT DOCUMENTS

| | | | | | |
|---|---|---|---|---|---|
| 261,454 | A | * | 7/1882 | Hoffman | 401/94 |
| 316,402 | A | * | 4/1885 | Rubin | 401/53 |
| 317,838 | A | * | 5/1885 | Mussinan, Jr. | 401/93 |
| 474,972 | A | * | 5/1892 | Sack | 401/93 |
| 750,583 | A | * | 1/1904 | Brown | 401/116 |
| 826,736 | A | * | 7/1906 | Neumeyer | 473/39 |
| 928,312 | A | * | 7/1909 | Lloyd | 401/117 |
| 1,063,134 | A | * | 5/1913 | Norris | 401/62 |
| 1,103,852 | A | * | 7/1914 | Tillou | 473/37 |
| 1,216,070 | A | * | 2/1917 | Carlson | 401/81 |
| 1,334,724 | A | * | 3/1920 | Tyler | 473/38 |
| 1,567,910 | A | * | 12/1925 | Brynda et al. | 401/33 |
| 1,674,808 | A | * | 6/1928 | Suzuki | 473/36 |
| 1,816,545 | A | * | 7/1931 | Porter | 401/82 |
| 1,983,728 | A | * | 12/1934 | Bafetti | 401/93 |
| 2,312,136 | A | * | 2/1943 | Van Triest | 401/92 |
| 2,947,557 | A | * | 8/1960 | Schwab et al. | 403/326 |
| 3,045,593 | A | * | 7/1962 | Petterson | D19/51 |
| 4,125,000 | A | * | 11/1978 | Grob | 464/162 |
| 4,135,274 | A | * | 1/1979 | Freeman | 15/244.1 |
| 4,247,216 | A | * | 1/1981 | Pansini | 403/109.3 |
| 4,679,954 | A | * | 7/1987 | Ambasz | 401/117 |
| D303,992 | S | * | 10/1989 | Grotsch | D19/35 |
| 5,002,182 | A | * | 3/1991 | McGinnis | 401/93 |
| 5,129,187 | A | * | 7/1992 | Cain | 473/35 |
| 5,417,503 | A | * | 5/1995 | Brennan, III | 401/92 |
| 5,509,743 | A | * | 4/1996 | Hao | 401/65 |
| 5,779,381 | A | * | 7/1998 | Muelver | 401/73 |
| 6,322,267 | B1 | * | 11/2001 | Shaffer-Bauck | 401/62 |
| 6,481,908 | B2 | * | 11/2002 | Lychwick | 401/92 |

FOREIGN PATENT DOCUMENTS

| | | | | | |
|---|---|---|---|---|---|
| GB | 2237244 | A | * | 5/1991 | B43K/9/00 |

* cited by examiner

*Primary Examiner*—Mitra Aryanpour
(74) *Attorney, Agent, or Firm*—Dennis A. Gross; The Hill Firm

(57) ABSTRACT

A safety chalk holder consisting of a chalk holding member received within the bore of a housing, a closed end of the chalk holding member projecting from one end of the housing, a collet end of the holder projectable into and out of the other end of the housing, a chalk receivable into the holder having a cross section dimensioned to cooperate with the collet such that when the collet end of the holder is positioned exterior of the housing, the chalk can be freely received within the collet, spring means urging the collet to be withdrawn into the housing, the collet effective to engage the housing to reduce the dimension of the collet to grasp the chalk as the collet is drawn into the holder, the holder and housing having a locked together connection permitting limited movement of the holder with respect to the housing, but preventing withdrawal of the entirety of the holder from the housing, and a child-proof cap closing the collet projecting end of the housing.

16 Claims, 2 Drawing Sheets

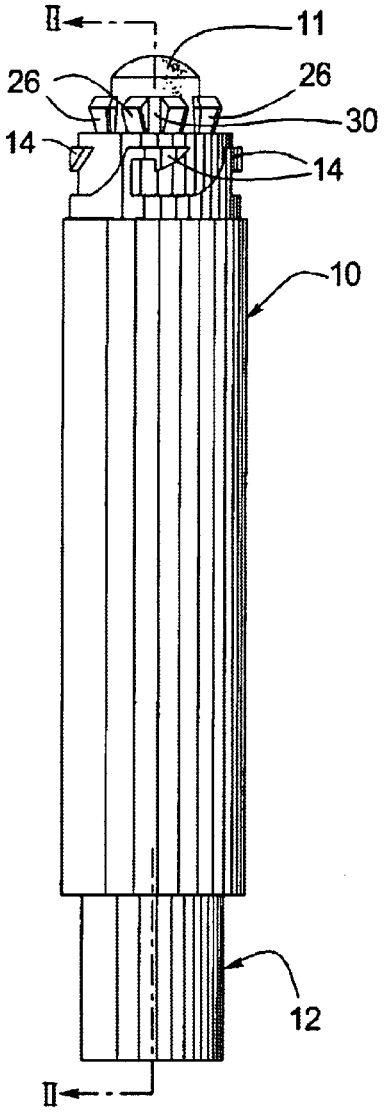
FIG. 1
FIG. 2
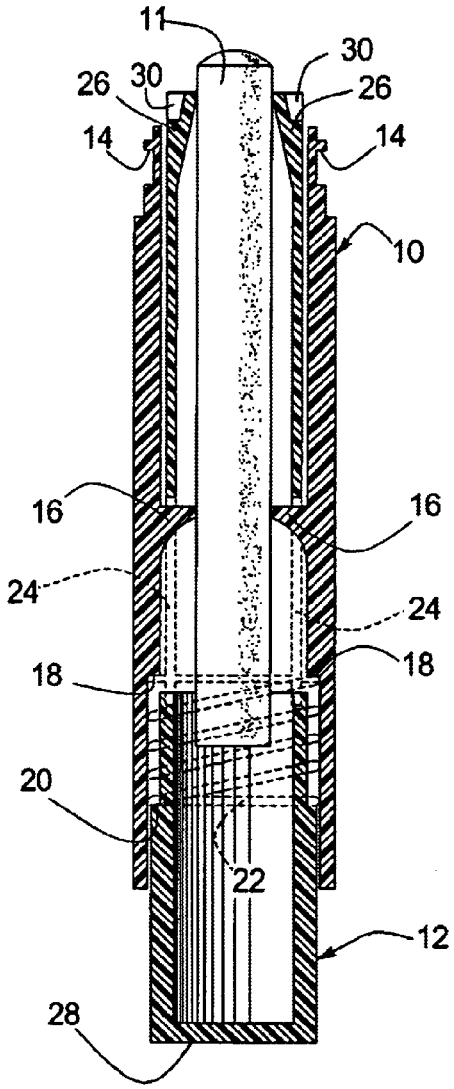

CHALK HOLDING DEVICE

RELATED CASE

This application is a continuation in part of provisional application Ser. No. 60/220,936 filed on Jul. 26, 2000.

FIELD OF THE INVENTION

The present invention relates to holders, especially holders for marking elements, such as chalk, crayon, charcoal, and the like.

BACKGROUND OF THE INVENTION

Chalk-holding devices are known in the prior art. Such devices are designed to allow easy access of the chalk or crayon, for example, to the user, which user is often a small child. Such prior art devices would not be suitable for use with insecticides.

Insecticide-containing chalks have been developed for applying to surfaces as a barrier to the entry of insects. These chalks have been shown to be quite effective. However, they are currently packaged in paper wrapping or in no wrapping at all, which can be messy and allows easy and undesirable exposure of the user to the insecticide in the chalk. The character of the material as a chalk also makes it an object of interest to children, especially young children. It would be desirable to provide a holder for the insecticidal chalk that is simple to use but that reduces exposure of the chalk itself to the user and also keeps the chalk out of the reach of children. It would also be desirable to have a way to prevent breakage and other damage to and avoid the waste of marking elements, such as chalk, crayons and the like for use in schools.

SUMMARY OF THE INVENTION

The present invention is directed to improved holding devices for marking elements. In one embodiment, the invention is directed to a child-proof insecticidal chalk holding device and methods for using the device to cleanly and safely hold and deliver an insecticidal chalk.

In an embodiment, the holder includes inner and outer generally cylindrical housing members, the inner member dimensioned to receive a cylinder of chalk which is movably axially within the inner member, the outer member dimensioned to receive the inner member interior thereof, a closed end on the inner member extending axially from one end of the outer member, an open end on the inner member extendable axially of the other end of the outer member, an interference lock between the inner and outer members limiting axial movement of the inner member to prevent withdrawal of the inner member entirely from the outer member, a child-resistant cap for closing the other end of the outer member whereby, with the cap in place, the chalk is inaccessible to the user and where, with the cap removed, the chalk is available only through the other end of the outer member.

In an embodiment, the holder consists of telescopically received inner and outer members with the inner member dimensioned to receive, interior thereof a chalk, collet jaws formed on one end of the inner member with the chalk projectable through the one end, another end of the inner member being closed, the inner member axially movable within the outer member, a mechanism limiting relative axial movement of the inner member and outer member preventing withdrawal of the inner member entirely from the outer member, the collet end of the inner member projecting from a first end of the outer member, and when projected from the first end allowing the chalk to move within the inner member to project from the inner member and outer member, the collet member not withdrawable into the inner member with chalk in the collet area, a biasing means urging the inner member to a position wherein the collet is entirely within the outer member, a child-proof closure cap for the collet first end of the outer member, the child-proof closure cap dimensioned such that it cannot be received in locked condition on the outer member when the collet portion of the inner member projects beyond the outer member.

The chalk holding device of the present invention comprises a) an elongate outer holder in the shape of a tube, the outer holder including a cap attachment open end which preferably comprising ratchet teeth adjacent a forward open end for accepting a child-resistant closure, a first retaining ridge circumferentially around its inner wall for retaining a resilient element, and at least one ramp extending out from its inner wall; b) a child-resistant closure; c) a chalk holder inner member slidably retained in said outer holder, said chalk holder comprising a second retaining ridge circumferentially around its outer wall for retaining said resilient element and at least one slot disposed along a portion of the longitudinal axis of said chalk holder for accepting said ramp of said outer holder in sliding engagement, the first end of the chalk holder being in the form of a collet and the second end being closed for transmitting pressure to a resilient element; and d) a resilient element disposed between said retaining ridges of said outer holder and said chalk holder.

The chalk holding device is useful for safely retaining and delivering a marking element, and preferably an insecticidal chalk. The chalk may be easily extended from the device and yet is firmly held in place. When not in use, the insecticidal chalk can be retracted and is safely out of the reach of children due to its child-resistant closure.

It is a principal object of this invention to provide a child-resistant safety enclosure for chalks, and in particular insecticide chalks, where the chalk is retained entirely within the holder until use and wherein the chalk is returned to being entirely within the holder upon completion of use and wherein the holder is resistive of being opened by a child.

It is another object of this invention to provide a chalk holder having a child-proof cap that forces the chalk to be disposed entirely within an inner holder upon application of the closure cap and where the inner and outer holders are locked together against separation.

BRIEF DESCRIPTION OF THE DRAWINGS

FIG. 1 is an illustration of one embodiment of the device of the invention, without the child-resistant screw cap, a piece of chalk being positioned in the device.

FIG. 2 is a cross-section of the device in FIG. 1, along the section line 2—2 of FIG. 1.

DETAILED DESCRIPTION OF THE INVENTION

Figure 3:
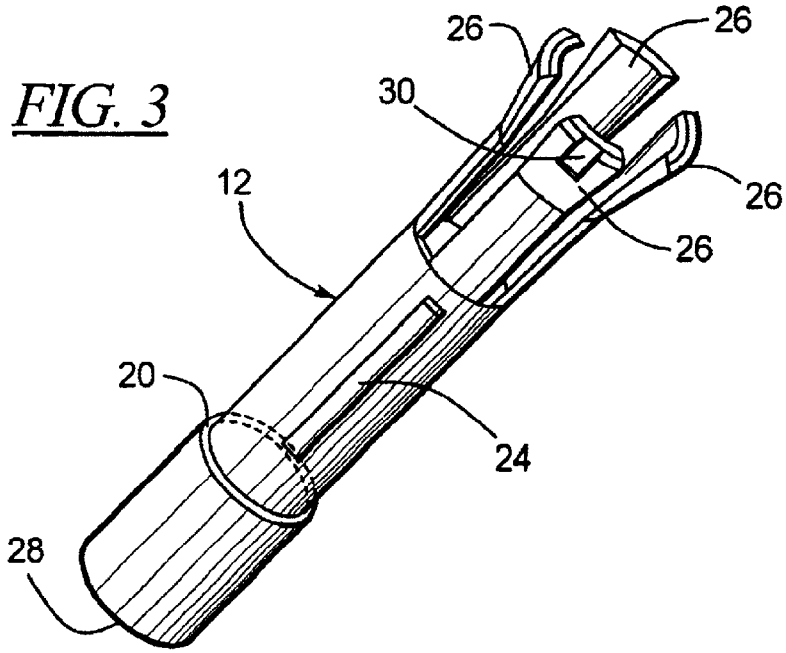
FIG. 3 is a schematic perspective view of the inner, chalk holder portion of the device of the invention.

The drawings and description of the invention that follow describe only one embodiment of this invention. It is to be understood that persons of ordinary skill in the art will find it apparent that modifications made be made to the device as illustrated and described without departing from the concepts of this invention. It will be further appreciated that certain features of the preferred embodiment as shown in the drawings and/or described hereinafter may be omitted, in part, or in their entirety or be modified in shape, position, dimension or design without departing from the concepts of this invention. Although I have chosen to illustrate the chalk holding device as being cylindrical or tubular, it should be readily apparent that other shapes, such as elliptical, rectangular and other cross section or the like may be chosen. Moreover, it is not necessary that the entire length of the device have the same configuration. For example, the exterior of the outer body may be configured to provide an ergonomically shaped gripping area. Unless otherwise apparent from the context, general reference to cylindrical or tubular shapes are intended to include variants thereof.

Referring to the embodiment of FIGS. 1 and 2, which illustrate one presently preferred embodiment of the invention, the chalk holding device comprises a tubular elongate outer body 10. The bore of outer tube 10 is large enough to permit the axial slidable retention of chalk holder 12. Each of outer tube 10 and chalk holder 12 may be of wood, metal, hard rubber, plastic, or any other suitable material. Plastic is presently preferred.

Figure 4:
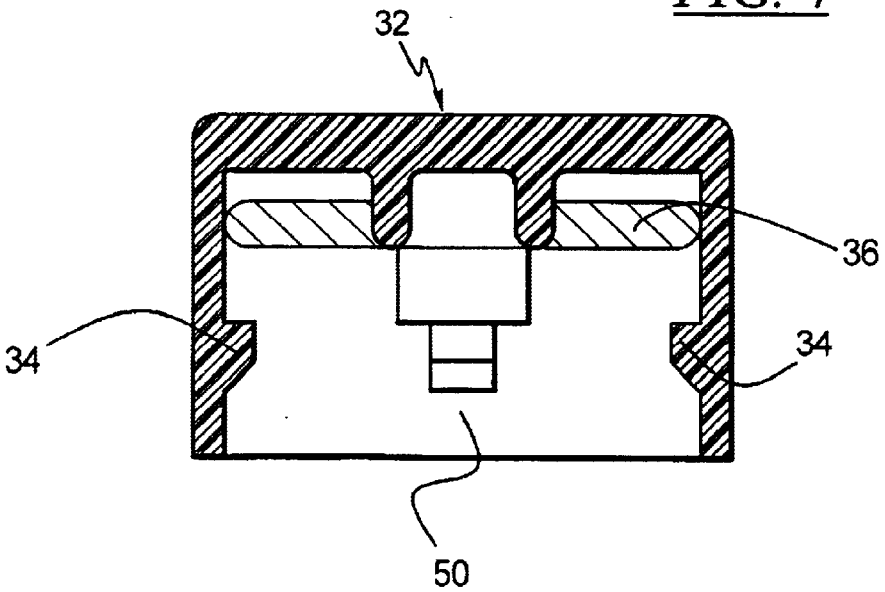
FIG. 4 is a cross-section of a child-resistant screw cap for use as a part of the device of the present invention.

At its forward end, the outer tube 10 has a plurality of ratchet teeth 14 for accepting a child-resistant screw closure cap having corresponding pawls. FIG. 4 shows one child-resistant screw cap 32 having pawls 34 and a flexible disk 36, which cap may be used with the outer tube. When the cap is screwed onto the chalk holding device, the pawls will engage with the ratchet teeth and the lip of the forward opening of the device rests on the flexible disk, which may be plastic or rubber for example. To enable the cap to be unscrewed, the cap must be pressed downwards while it is rotated in a counter-clockwise direction to push the pawls below the ratchet teeth, thus disengaging them. When the cap is pushed downward, the lip of the device is pushed up into the flexible disk, which acts as a spring. Such caps may be commercially available. In a presently preferred embodiment, the cap is available from Owens-Brockway (Skokie, Ill. 60077; product no. CM-8237). It will be apparent to those skilled in the art that I have chosen to illustrate a common available-type of child resistant cap and that many other child-resistant caps will be available and substitutable. For example, child-resistant caps requiring squeezing of the cap skirt to engage an internal locking member for unthreading may be utilized. Moreover, although I have illustrated a cap which has the skirt extending about the outer diameter of the outer tube, internally extending caps may also be utilized. One significant advantage, however, of the cap as illustrated is the provision of an internal projection extending axially from the underside of the cap end wall. This projection serves not only to retain the disc 36, it can engage the projecting end face of the chalk 11 in such a manner as to ensure that the cap cannot be positioned to its full locked condition until the chalk has been withdrawn fully into the inner body or chalk holder 12, as will be more fully explained hereinafter.

As illustrated in FIG. 2, outer tube 10 has at least one, and preferably at least two, ramps 16 extending out from its inner wall, as well as a first spring-retaining ridge 18 forming a stop surface running circumferentially around its inner wall.

Chalk holder 12 comprises a second spring-retaining ridge 20 circumferentially around its outer wall (see, FIGS. 2 and 3). Chalk holder 12 also comprises at least one, and preferably at least two, slots 24 disposed along a portion of the longitudinal axis of the chalk holder for accepting ramps 16 in sliding engagement. This allows the chalk holder 12 to slide up and down within the outer tube 10 but keeps the holder from coming completely out of the outer tube. The bore of chalk holder 12 is large enough to permit passage through of a piece of chalk 11 or other element to be held. At its forward end, the chalk holder is formed as a collet with a plurality of jaw members or spring fingers 26 having beveled surfaces, which jaw members are adapted to slide in and out of the forward end of outer tube 10. The jaws together define a central chalk-accommodating aperture, the arrangement being such that when the jaws are urged rearwardly with relation to the outer tube, they are wedged into clamping engagement with the chalk to hold the latter in place. It will be appreciated that the design of the collet may be varied. For example, in FIGS. 1 and 3, I have shown the collet fingers as having substantially constant curvature inner diameter faces and an outer diameter face that increase towards the open end of the fingers. This can be referred to as an external ramping collet. In FIG. 2, I have shown an opposite thickening of the fingers which could be referred to as an internal ramping. In each instance, the fingers or jaw members 26 have a natural, free state having an inner diameter greater than the diameter of the chalk 11 and an outer diameter, in the free state greater than the inner diameter of the bore opening of the outer tube 10 such that when the chalk holder 12 is projected from the forward end of the outer tube, the fingers or jaw members 26 will spread apart sufficiently to allow the chalk to freely move axially within the chalk holder and to project through the aperture of the chalk holder the desired distance. However, upon withdrawal of the chalk holder into the outer tube, the inner diameter distance of the jaw members or fingers will become constricted to engage the outer diameter of the chalk and to grip the chalk. As illustrated in FIGS. 1 and 2, gripping of the chalk will occur while a portion of the chalk holder remains projected partially out of the forward end of the outer tube. The gripping of the chalk at this position will limit further constriction of the chalk holder at a time when the outer diameter of the chalk gripping end of the chalk holder will still be greater than the inner diameter of the bore of the outer tube thereby preventing the chalk holder from being withdrawn entirely into the outer tube when the chalk is positioned at the open end of the chalk holder radially interiorly of the ends of the jaw members or fingers 26. At its rear end, chalk holder 12 is closed and functions as a platform 28 for transmitting pressure to the chalk holder to slidably move the jaws of the chalk holder forward in relation to the outer tube 10.

Resilient element 22 is placed between first retaining ridge 18 of the outer tube and second retaining ridge 20 of the chalk holder. In the illustration and in a presently preferred embodiment, the resilient element is a coiled spring; however, it is not limited thereto and may also be, for example, a bar spring, a rubber band, or the like as would be known to those of skill in the art. When pressure is applied to platform 28, chalk holder 12 is pushed forward in the outer tube to move the jaws out of the forward end of the outer tube, thus releasing the chalk from the hold of the jaws. If, at this point, the chalk holding device is tilted backwards (that is, if the forward end is tilted up), the chalk will fall into the tube. Alternatively, if the forward end of the device is tilted downward, the chalk will move further out of the tube. When pressure is released from platform 28, the resilient element 22 will urge the jaws in the rearward direction to again wedge the jaws against the chalk to hold the chalk in place. Thus, the chalk may be advanced as it is worn. When not in use, the chalk can be returned into the body of the device and the device sealed by the child-resistant screw closure cap, to store the insecticidal chalk and prevent it coming into inadvertent contact with people, including small children, or pet animals. The jaws also can retract completely into the device.

The jaws may be made of rubber, plastic or other flexible material. They are designed in such a manner to give a good frictional grip without injuring the chalk. Because of the flexible nature of the jaws, the chalk holding device can accommodate a variety of diameters of chalk or other elements to be held.

Those jaws that are aligned with the slots in the chalk holder are designed to include a notch 30 at their top outer edge. These notches are used to assist in lining up the slots with the ramps on the inner wall of the outer tube, so that the ramps will properly be seated into the slots when the device is put together. To assemble the device, the resilient element is slipped over the forward end of the chalk holder and placed adjacent to the second retaining ridge. A piece of chalk or other element to be held is placed in the bore of the chalk holder. The notches of the chalk holder jaws are aligned with the ramps inside the outer tube and the chalk holder, with chalk and resilient element, is pushed into the tube through the tube's bottom end. The ramps fall into the slots in the chalk holder and, due to the 90° angle of the top of each ramp, the chalk holder is permanently retained in the outer tube and the device cannot be disassembled by children. The child-resistant screw closure cap may be screwed onto the device either before or after the chalk holder is inserted.

It will, therefore, be appreciated that this invention provides a child-protecting chalk holder. Unless the chalk is entirely withdrawn into the chalk holder, the chalk holder will not be withdrawable into the outer tube due to the larger diameter of the spring fingers or jaws 26 than the bore of the outer tube when the inner diameter of the fingers are in engagement with the outer diameter of the chalk. At that position, the spring continues to urge the chalk holder away from the forward end of the outer tube or holder to withdraw the chalk holder into the outer tube. The dimensional relationship between the outer diameter of the fingers, the inner of the bore and the outer diameter of the chalk prevent such movement from occurring whereby the chalk is held for use. However, upon pressing the end 28 and projecting the chalk holder further from the open end of the outer tube 10, the gripping of the chalk is released and the chalk can fall freely into the interior of the chalk holder. Thereafter, the spring urging will result in the chalk holder being withdrawn into the interior of the outer tube. At this point, even though the cap may not yet be fixed, the chalk is out of reach and cannot be accessed until such time as the holder is again depressed against the spring. By fully dimensioning the holder and choosing an appropriate spring force, protection against inadvertent contact between the chalk and children can be provided. Importantly, it will be appreciated that because the fingers have an internal dimension less than the chalk's outer dimension, when the fingers are withdrawn into the outer holder the chalk cannot fall out of the holder even in the absence of the child resistant cap. Thus, the holder provides safety even in the event of inversion with the cap off. Moreover, due to the widening of the fingers at their ends, a chalk received within the inner holder cannot extend to the end of the inner holder when the fingers are constricted by being positioned interior to the outer holder. Further, by providing the internal projection 50 of the cap, it can be assured that the cap cannot be placed over the open end of the holder and locked in position unless the chalk has been withdrawn into the interior of the chalk holder beyond the ends of the jaws or spring fingers 26. Again, it will be apparent to those of ordinary skill in the art that variations can be provided. For example, the projection 50 instead of being centrally located to engage the chalk end face, could be positioned radially outwardly to engage the ends of the jaws or spring fingers 26. Moreover, it will be apparent to those of ordinary skill in the art that the slots 24 and ramps 16 may be configured so as to provide a lock against pressing the chalk holder axially within the outer holder to release the chalk. This can be accomplished, for example, by providing a circumferentially extending leg at the distal end of the slots adapted to receive the ramps such that upon rotation of the chalk holder with respect to the outer tube, the ramps will be positioned in the circumferential extensions and be locked against axial movement. Additionally, if desired, a bayonet-type slot/ramp connection may be utilized. In each instance, it will be required to provide rotational movement to free the chalk holder for movement axially.

Although I have described my invention in connection with a preferred embodiment shown in the drawings, it is to be understood that others may choose to practice my invention in other ways and in other shapes, styles, and types of devices. I intend to cover all such devices as may fall within the scope of my invention.

I claim as my invention:

1. Chalk holder comprising inner and outer axially movable hollow members having a plurality of stop surfaces associated therewith, at least one stop surface formed interior of the outer member, at least another stop surface on the inner member located interior of the outer member, the inner and outer member's stop surfaces being in opposition to one another inside of the outer member, the stop surfaces effective to limit relative axial movement of the members, the inner member having chalk engaging collet fingers at one end thereof projectable beyond an end of the outer member, a spring received interior of the outer member effective to urge the fingers towards a position interior of the outer member.

2. The chalk holder of claim 1 wherein at least some of the plurality of the stop surfaces are radially overlapping.

3. The chalk holder of claim 2 wherein the stop surfaces limit axial movement in both axial directions while providing a range of axial movement between limit positions.

4. The chalk holder of claim 3 wherein the spring is interposed between at least two of the stop surfaces urging the members in one axial direction.

5. The chalk holder of claim 4 wherein at least a first of the stop surfaces includes a radially inwardly extending projection on the inner surface of the outer member which projects into an axial slot in the inner member and wherein another of the stop members compromises an axial end of the slot.

6. Chalk holder comprising inner and outer axially movable members, the outer member being hollow having an inner surface defining an interior, a stop surface positioned interior of the outer member, a stop surface on the inner member interior of the outer member, the inner and outer members stop surfaces being in opposition to one another, the stop surfaces effective to limit relative axial movement of the members, wherein the inner member terminates at one end in a plurality of projecting circumferentially spaced fingers extensible from an open end of the outer member upon movement of the inner member within the outer member within the range of movement permitted by the steps stop surfaces, a spring urging the fingers into the outer member.

7. The chalk holder of claim 6 wherein the fingers act as a collet and have an interior dimension, at their distal end, less than the outer dimension of a chalk received within the holder when the fingers are withdrawn into the interior of the outer holder and a free dimension greater than the exterior dimension of the chalk when the fingers are maximally projected from the open end of the outer member.

8. The chalk holder of claim 7 including a child-proof safety cap closing an open end of the outer member.

9. A chalk holder of claim 7 wherein the chalk is prevented by the fingers from falling out of the chalk holder when the fingers are withdrawn into the interior of the outer holder.

10. A chalk holder of claim 8 wherein the cap, holder and collets are dimensioned to prevent engagement of the cap with the holder when the collet fingers are projecting from the holder with a chalk positioned in the collet.

11. A safety chalk holder comprising inner and outer telescopic holders, the inner holder adapted to receive interior thereof a chalk and having a closed end and an open end, the open end defined by a plurality of collet fingers adapted to receive and grip the chalk, the open end of the inner holder being extensible from and retractable into an open end of the outer holder, the collet fingers having a major exterior dimension greater than an interior dimension of the open end of the outer holder when a chalk is gripped by the fingers, the chalk being storable within the inner holder at a storage position spaced from the fingers, the fingers collapsible to a second exterior dimension less than the open end of the outer member when the chalk is in the storage position, and opposed abutments on the inner and outer holders limiting telescopic movement to prevent separation of the holders.

12. The chalk holder of claim 11 wherein the opposed abutments are positioned interior of the outer holder.

13. The chalk holder of claim 11 wherein the outer holder has an open end through which the collet fingers may project, the open end being closed by a child-resistant cap.

14. A safety chalk holder comprising a housing member having an opening extending therethrough between open ends, a chalk holder received in the opening having a first closed end projecting from one open end of the housing member, the chalk holder having an internal cavity adapted to receive a chalk, a second end of the chalk holder forming a chalk engaging collet for grasping a peripheral surface of the chalk when the chalk is positioned at the second end, the collet being projectable from and withdrawable through a second of the open ends of the housing member, the second of the open ends dimensioned to cooperate with the collet to constrict the collet to a dimension less than the dimension of the chalk when the collet passes through the second open end whereby the collet may not be withdrawn into the holder when chalk is present at the collet, an abutment carried by at least one of the housing and holder interior of the housing effective to limit movement of the holder within the opening to prevent the holder from being withdrawn entirely through either open end of the housing and means urging the collet into the holder.

15. A chalk holder consisting of telescoping inner and outer cylindrical members with the innermost member having a first end terminating in a plurality of flexible fingers acting as a collet having an interior dimension less than the interior dimension of other portions of the interior member when the fingers are positioned interior of the outer member, a spring interposed between the inner and outer member urging the fingers in a direction to withdraw the fingers into the outer member, a chalk in the inner member having a dimension greater than the interior dimension of the fingers when the fingers are withdrawn into the outer member whereby the chalk cannot fall out of the holder when the holder is positioned collet end down.

16. Chalk holder comprising inner and outer axially movable members, a stop surface interior of the outer member, a stop surface on the inner member, the inner and outer members stop surfaces being in opposition to one another, the stop surfaces effective to limit relative axial movement of the members, the outer member having a radially inwardly projecting stop surface and the inner member having an axial slot receiving the inwardly projecting stop surface engageable with an axial end of the slot, the inner member comprising a receiving body for a chalk and a resilient member urging the inner member into the outer member.

* * * * *